United States Patent [19]

Bowen

[11] 4,418,865

[45] Dec. 6, 1983

[54] CONTINUOUS MAILER ASSEMBLY

[75] Inventor: Charles G. Bowen, Patterson, N.Y.

[73] Assignee: Transkrit Corporation, Elmsford, N.Y.

[21] Appl. No.: 290,318

[22] Filed: Aug. 5, 1981

[51] Int. Cl.[3] ..... B65D 27/10

[52] U.S. Cl. ..... 229/69

[58] Field of Search ..... 229/69, 73

[56] References Cited

U.S. PATENT DOCUMENTS

| | | | |
|---|---|---|---|
| 2,931,559 | 4/1960 | Hilliard | 229/73 |
| 3,360,184 | 12/1967 | Greason | 229/73 |
| 3,411,699 | 11/1968 | Pine et al. | 229/73 |
| 3,419,286 | 12/1968 | Noonan et al. | 229/69 |
| 4,190,162 | 2/1980 | Buescher | 229/73 |

FOREIGN PATENT DOCUMENTS

| | | | |
|---|---|---|---|
| 1354196 | 5/1974 | United Kingdom | 229/69 |

*Primary Examiner*—Stephen P. Garbe

*Attorney, Agent, or Firm*—Kenyon & Kenyon

[57] ABSTRACT

The mailer is made of three plies which define an outgoing envelope with a removable tab, a message ply and a return envelope. The back ply has a flat portion which folds over to seal the return mail envelope and is provided with remoistenable glue.

17 Claims, 12 Drawing Figures

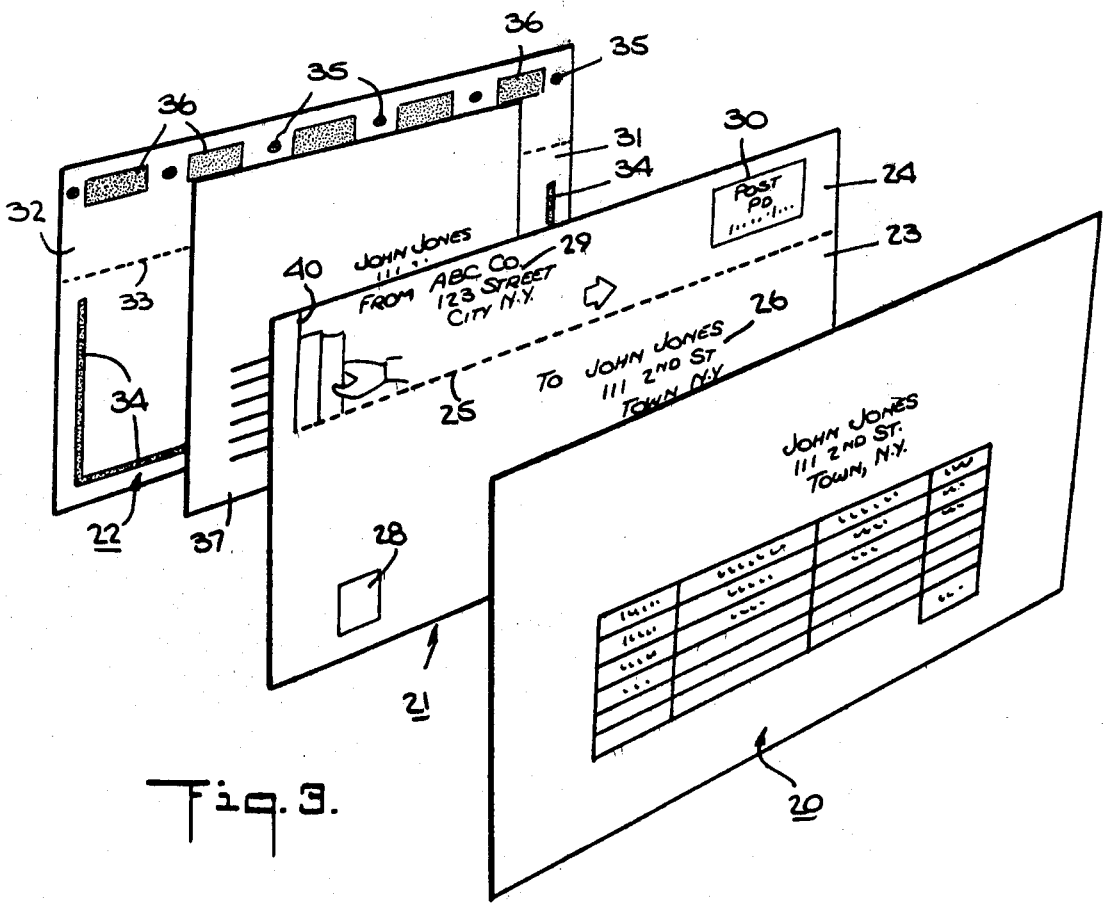
Fig. 3.
Fig. 9.
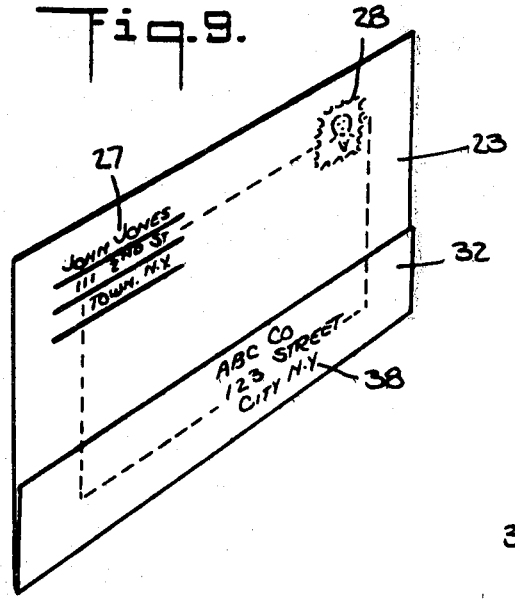
Fig. 10.
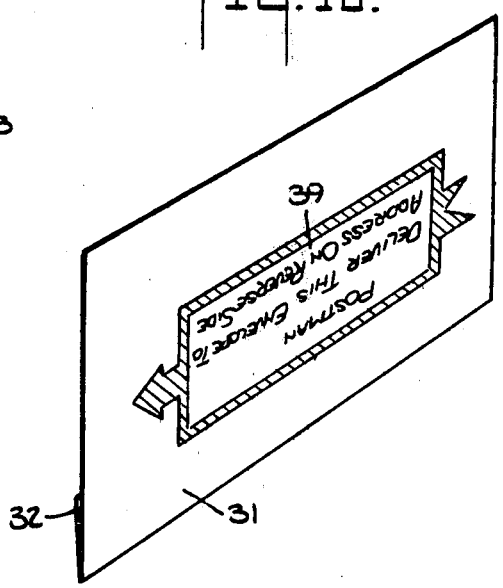

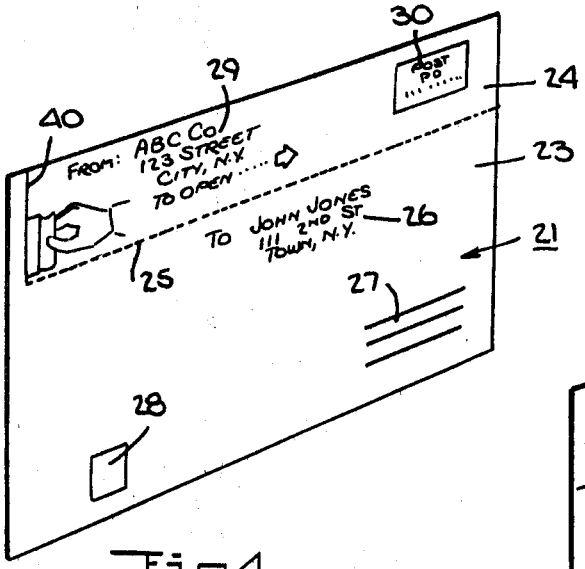
Fig. 4.
Fig. 5.
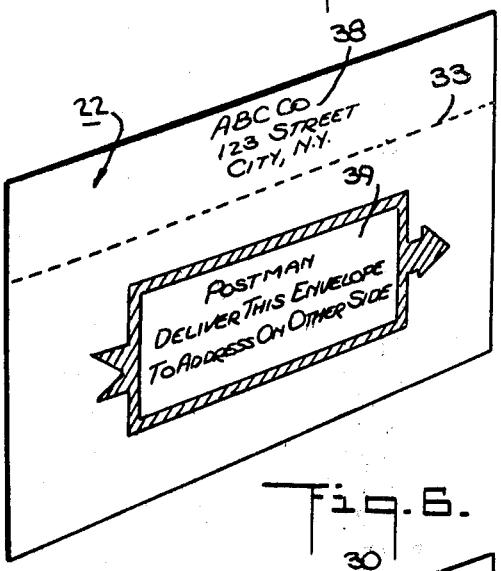
Fig. 6.
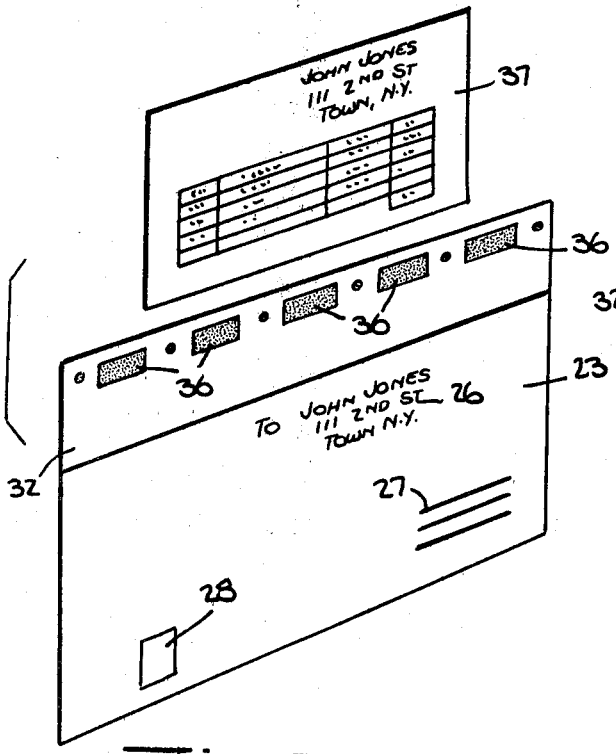
Fig. 7.
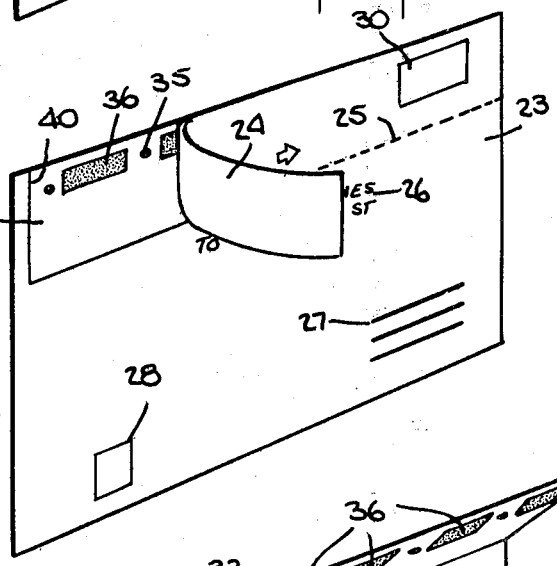
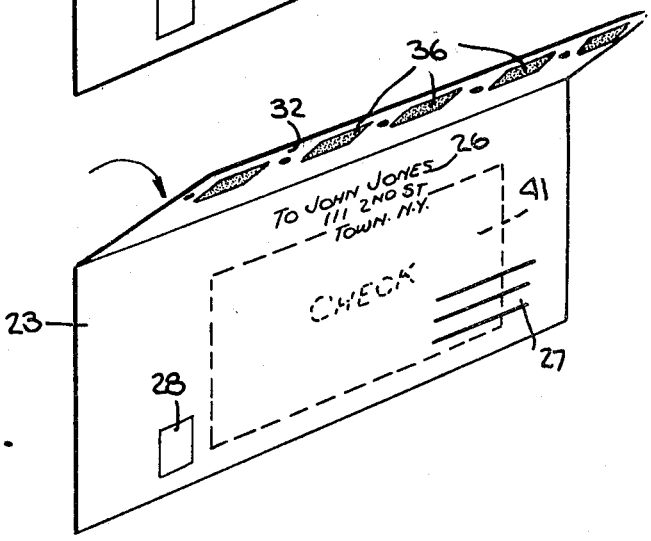
Fig. 8.

CONTINUOUS MAILER ASSEMBLY

This invention relates to a continuous mailer assembly. More particularly, this invention relates to a continuous mailer assembly having a mailer with a return envelope incorporated therein.

As is known, various types of continous mailer assemblies have been used for mailing information and which provide return envelopes which can be returned to a sender. In some cases, the continuous mailer assemblies have been constructed so that the mailers are in a form wherein a side can be removed to expose the contents. Usually, the contents include one or more inserts and a return mail envelope in which the inserts can be returned to the original sender. However, these constructions have not always been easy to open and, in some cases, opening of the mailers has damaged portions of the inserts.

In order to improve on these constructions, it is known to make a continuous mailer with a return mail envelope which is opened and ready for sealing upon opening of the mailer, as described in U.S. Pat. No. 4,157,759. Another mailer construction is known wherein a front ply can be removed along with a strip of an intermediate ply so that the remainder of the intermediate ply and a back ply form a return envelope for various inserts disposed within the mailer, for example as described in U.S. patent application Ser. No. 234,727, filed February 17, 1981, now U.S. Pat. No. 4,384,670. However, in the first type of mailer, five plies are required in order to form the mailer, insert plies and return envelope. In the second case, four plies are required in order to form the mailer, return envelope and insert. In both cases, tenting may pose a problem in a continuous mailer assembly using these types of construction. Further, in the case of the four-ply construction, the insert plies are sized to lie below the plane of the return envelope so as to clear a tear-off portion of the mailer and be able to fit into the return envelope. This limits the amount of information which can be placed on the inserts.

Accordingly, it is an object of the invention to provide a mailer which is made of a minimum of plies to form an outgoing envelope, a message ply and a return envelope.

It is another object of the invention to maximize the size of the message ply contained within a mailer for return mail purposes.

It is another object of the invention to provide a mailer which can be made in a relatively simple and economic manner.

It is another object of the invention to provide a mailer which can be easily understood by a user.

It is another object of the invention to provide a mailer which can be utilized in computer printers of less sophisticated construction.

It is another object of the invention to provide a continuous mailer assembly which is subject to a minimum of tenting.

Briefly, the invention provides a mailer which is comprised of a front ply for receiving information thereon and a back ply peripherally secured to the front ply to define a first enclosed pocket therewith. The front ply includes a body portion having a designated address area thereon and a removable tab portion which is adjacent the body portion. The back ply has a main portion secured to the body portion of the front ply to define a return mail pocket therewith and a flap portion underlying the tab portion for folding over onto the body portion after removal of the tab portion.

In addition, the mailer has adhesive means on the flap portion for sealing against the body portion so as to close the return mail pocket. The adhesive means used on the flap portion may be in the form of spaced apart blocks or a line of remoistenable glue or any other suitable adhesive material. Also, releaseable glue spots or the like may be used to releaseably secure the removable tab portion of the front ply to the flap portion of the back ply.

The mailer also has at least one insert message ply in the pocket defined by the front and back plies. This insert ply may be sized to fit within the pocket and to extend out of the pocket to under the flap portion. In this way, a maximum number of lines of information can be placed on the insert.

The mailer construction is thus formed of three plies so as to create three documents, namely an outgoing envelope with an easy to open removable tab feature, a message ply which could incorporate a detachable remittance stub by means of a vertical or horizontal perforation and a return envelope.

In one embodiment, the mailer may have the designated address area on the front ply located in an upper region while the flap portion is of a width to cover this address area when folded over. The body portion of the front ply may also be provided with a return address area on a front side spaced from the designated address area while the flap portion has a second designated address area on the backside. Thus, when the flap portion is folded over to form the return envelope, the second designated address area can be readily viewed while the first designated address area is covered over.

In another embodiment, the mailer may have the designated address area on the front ply located in a lower region so that the flap portion does not fold over onto the address area. In this case, the backside of the back ply may carry a designated address area while the flap portion carries a suitable notice to indicate that the envelope is to be delivered to the address indicated on the reverse side, i.e., the backside of the mailer.

The invention also provides a continuous mailer assembly comprised of a plurality of continuous webs which are disposed in overlying relation with each web having a removable strip with control line holes along each of two opposite marginal edges as well as a plurality of transverse lines of weakening in order to divide the webs into a series of interconnected multiple-ply sections. Each of these sections includes one or more removable first plies, a second ply including a body portion and a tab portion removably secured to the body portion and a third ply including a main portion secured to the body portion to define a pocket therewith and a flap portion removably secured to the tab portion for folding over onto the body portion after removal of the tab portion and first ply. Any suitable adhesive means may be used to releaseably secure each of the tab portions to an underlying flap portion.

Each multiple-ply section also includes at least one additional ply between the second and third plies in order to define at least one insert message ply between each body portion and main portion of the respective plies.

The construction is such that the second and third plies of each section of the assembly form a mailer while the body portion of the second ply and the entire third ply of each section form a return mail envelope.

In use, the continuous mailer assembly can be processed through automatic equipment, such as a computer printer, via the control line holes. At this time, printed information can be applied to the face of the top web, that is the web forming the removable ply, while additional information is applied in known fashion to the underlying webs which form a series of interconnected mailers. Thereafter, the strips containing the control line holes can be removed, the top web or webs removed for retention or audit purposes and the series of interconnected mailers stacked for mailing purposes.

Each mailer is formed so that the designated address area on the body portion of the ply with the removable tab portion appears on the body portion. In a similar manner, the tab portion can be provided with a return address area and a space to receive a stamp. Upon receipt of the mailer by an addressee, the tab portion is removed. The contents of the mailer can then be removed and the remainder of the mailer is then immediately ready for use as a return mail envelope. One or more of the inserts or portions thereof or other items can then be placed in the return mail envelope and the exposed flap portion on the back ply folded over the front face of the front ply in order to seal the pocket. At this time, in the case of the first embodiment, the designated address area on the backside of the flap portion now appears on the front of the return mail envelope while the designated address area on the body portion of the front ply is covered over by the flap portion of the back ply. The closed return mail envelope in either embodiment can then be stamped and returned to the original sender.

It is to be noted that the mailer assembly can be provided with information in any known conventional manner. To this end, the various plies of the assembly can be provided with various carbon spots or coatings of an image transfer medium at predetermined locations in order to transfer information onto one or more plies.

Further, it is to be noted that the designated address areas and return address areas may be placed on the mailer construction in any suitable region to permit handling by postal authorities in a convenient manner.

These and other objects and advantages of the invention will become more apparent from the following detailed description taken in conjunction with the accompanying drawings in which:

FIG. 3 illustrates an exploded view of a section of the mailer assembly of FIG. 1;

FIG. 4 illustrates a front view of a mailer constructed in accordance with the invention;

FIG. 5 illustrates a back view of the mailer of FIG. 4;

FIG. 6 illustrates the mailer of FIG. 4 during removal of a tab portion;

FIG. 7 illustrates an exploded view of the return mail envelope portion of the mailer;

FIG. 8 illustrates a view of the return mail envelope during folding of the flap portion;

FIG. 9 illustrates a sealed return mail envelope in accordance with the invention;

FIG. 10 illustrates a back view of the return mail envelope of FIG. 9;

Figure 1:
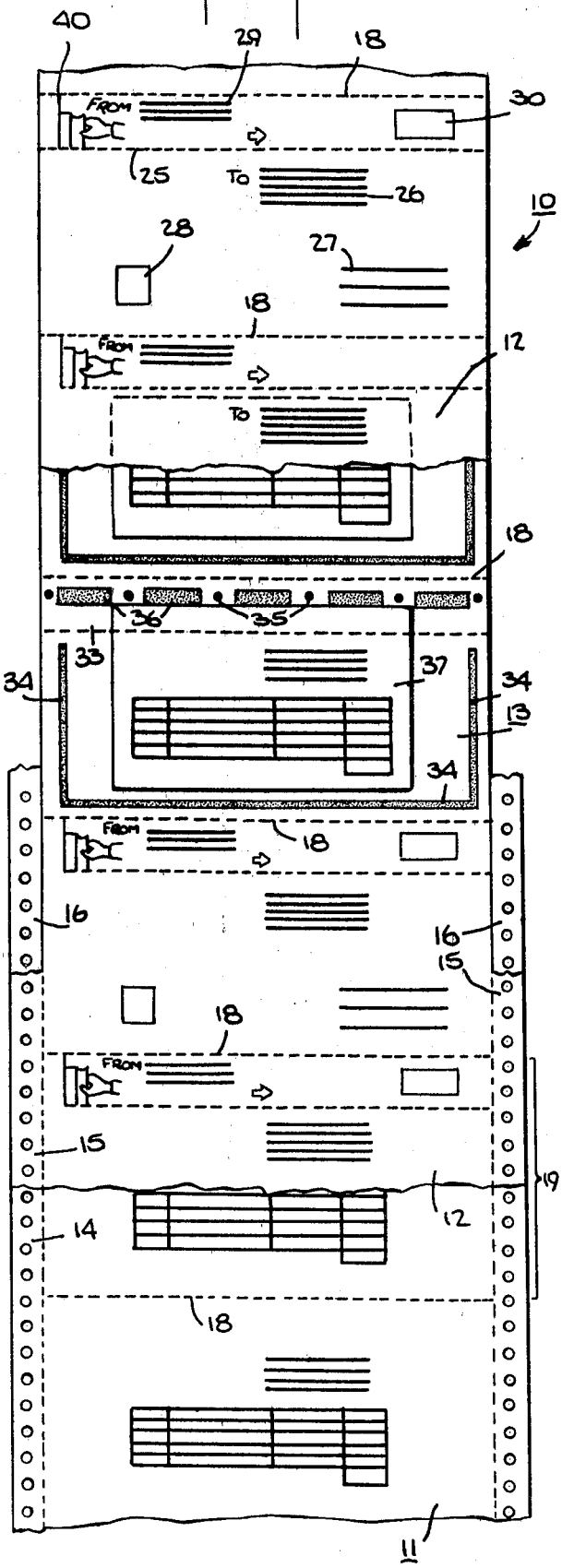
FIG. 1 illustrates a partially broken view of one embodiment of a continuous mailer assembly constructed in accordance with the invention.
Figure 2:
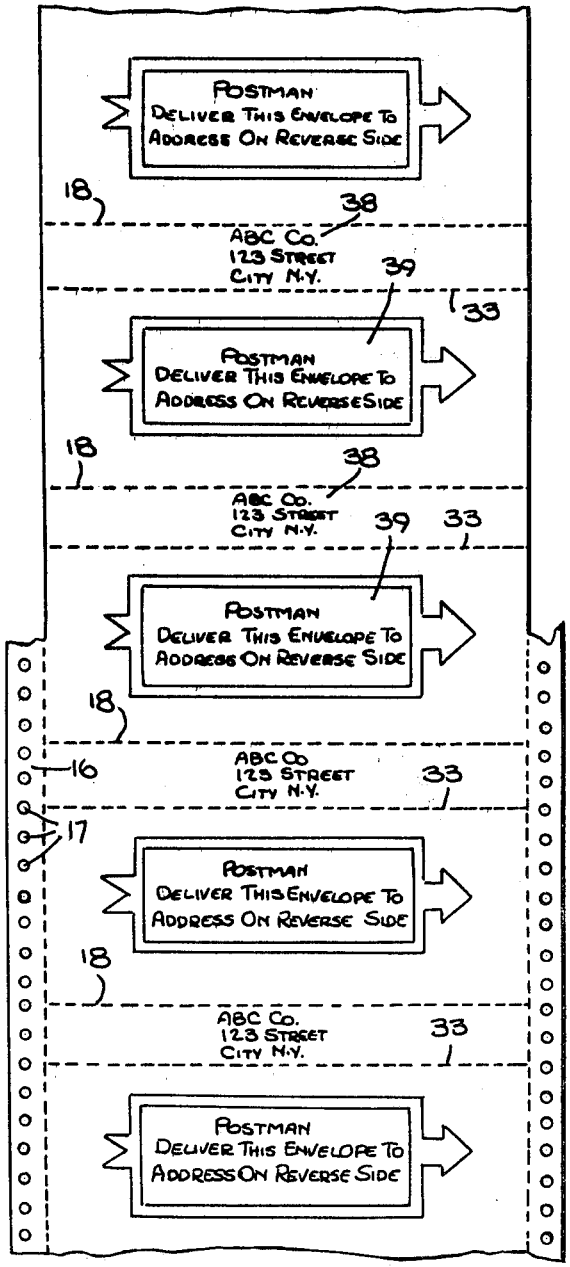
FIG. 2 illustrates a backside view of the continuous mailer assembly of FIG. 1.

Referring to FIGS. 1 and 2, the continuous mailer assembly 10 is comprised of a plurality of continuous webs, for example three webs 11, 12, 13 which are disposed in overlying relation. Each of these webs 11, 12, 13 has a removable strip 14, 15, 16, respectively, along each of two opposite marginal edges provided with control line holes 17. In addition, each web 11, 12, 13 has a plurality of transverse lines of weakening 18 to divide the webs into a series of interconnected multiple ply sections 19.

Referring to FIGS. 1 and 3, each section 19 of the assembly includes a removable first ply 20, for example in the top web 11 (see FIG. 1) and two interconnected plies 21, 22 which form a mailer.

As indicated in FIG. 3, the removable top ply 20 may be provided with printed information in any suitable known manner.

The intermediate ply 21 includes a body portion 23 and a tab portion 24 which is removably secured to the body portion 23, for example via a line of perforations 25 which extends across the ply 21. This ply 21 forms a front ply of the mailer.

In addition, as shown in FIG. 4, the body portion 23 is provided with a designated address area 26 in an upper portion, a return address area 27 on a front side which is spaced from the designated address area 26 and a location 28 for a stamp.

The tab portion 24 is provided with a return address area 29 and a stamp or postal indicia location 30 as indicated in FIG. 3.

The remaining ply 22 forms a back ply of the mailer. This ply 22 includes a main portion 31 and a flap portion 32 which is separated from the main portion 31 via a line of perforations 33. The main portion 31 is secured to the body portion 23 of the ply 21, for example by three lines of adhesive 34 which define a U-pattern. The flap portion 32 underlies the tab portion 24 of the ply 21 and is removably secured thereto, for example, by means of releaseable or fugitive glue spots 35. The flap portion is also provided with adhesive means, for example in the form of spaced apart blocks or remoistenable glue 36, for sealing against the body portion 23 of the ply 21 as described below.

Each section 19 of the mailer 10 also includes an insert message ply 37 between the plies 21, 22 of a mailer. The insert message ply 37 can be positioned within the assembly 10 in any suitable known manner, for example as described in U.S. Pat. No. 4,157,759. As indicated, the insert ply 37 can extend upwardly out of the pocket to be between the tab portion 24 and flap portion 32, e.g. lying over a lower portion of the glue blocks 36 and below the fugitive glue spots 35.

As such, lines of printing can be made on the insert ply not only under the body portion 23 but also under the tab portion 24.

As shown in FIG. 2, each back ply 22 has a designated address area 38 within the backside of the flap portion. A suitable notice location 39 may also be provided on the backside of each ply 22 to indicate that the envelope is to be delivered to the address indicated on the reverse side, i.e. the front side of the mailer.

In use, the continuous mailer 10 is processed in any suitable type of automated equipment so as to impart various information of the top ply 11, the individual front plies 21 of the respective mailers and the insert plies 37. After processing, the strips 15 containing the control line holes 17 are stripped from the assembly 10. The top web 11 can then be separated from the assembly 10 and retained in a suitable place for audit or like purposes. The remaining webs 12, 13 which form a series of interconnected mailers can then be stacked or separated from each other along the lines of weakening 18 for mailing purposes.

Referring to FIG. 4, the tab portion 24 of a mailer can be provided with a slit 40 which extends to the line of perforations 25 in order to provide a free edge which can be lifted and peeled back. This free edge can be used to facilitate removal of the tab portion 24 from the mailer.

Referring to FIG. 6, upon receipt by an addressee, the tab portion 24 of the mailer is stripped from the mailer along the line of perforations 25. This portion 24 and the stamp 30 thereon can then be discarded. At this time, the flap portion 32 of the back ply is exposed along with the contents of the mailer.

Referring to FIG. 7, upon opening of the mailer, the body portion 23 and back ply 22 form a return mail envelope which includes a pocket between the body portion 23 and the main portion 31 of the back ply 22. At this time, the insert message ply 37 can be removed. A portion of this message ply 37 can then be returned to the return envelope along with any other information, for example a check 41 as shown in FIG. 8. At this time, the blocks 36 of remoistenable glue are moistened and the flap portion 32 is folded over along the line of perforations 33 onto the face of the body portion 23 to seal against the face of the body portion 23 and close the return mail envelope.

Referring to FIG. 9, the flap portion 32 is of a width so that when the flap portion 32 is folded over, the designated address area 26 of the front ply 21 is covered. The designated address area 38 on the flap is then exposed on the front of the return mail envelope. At this time, a return address can be inserted in the designated area 27 and a stamp placed in the stamp location 28 for return purposes. As indicated in FIG. 10, the back of the return mail envelope simply shows the notice 39.

As indicated in FIG. 1, the insert message ply 37 is of a size to fit within the frame defined by the lines of adhesive 34 and the fugitive glue spots 35. This allows the insert ply 37 to be sized to receive a maximum number of lines of information e.g. three or four more than in constructions in which a return mail envelope and insert are placed within the same pocket of a mailer.

Figure 11:
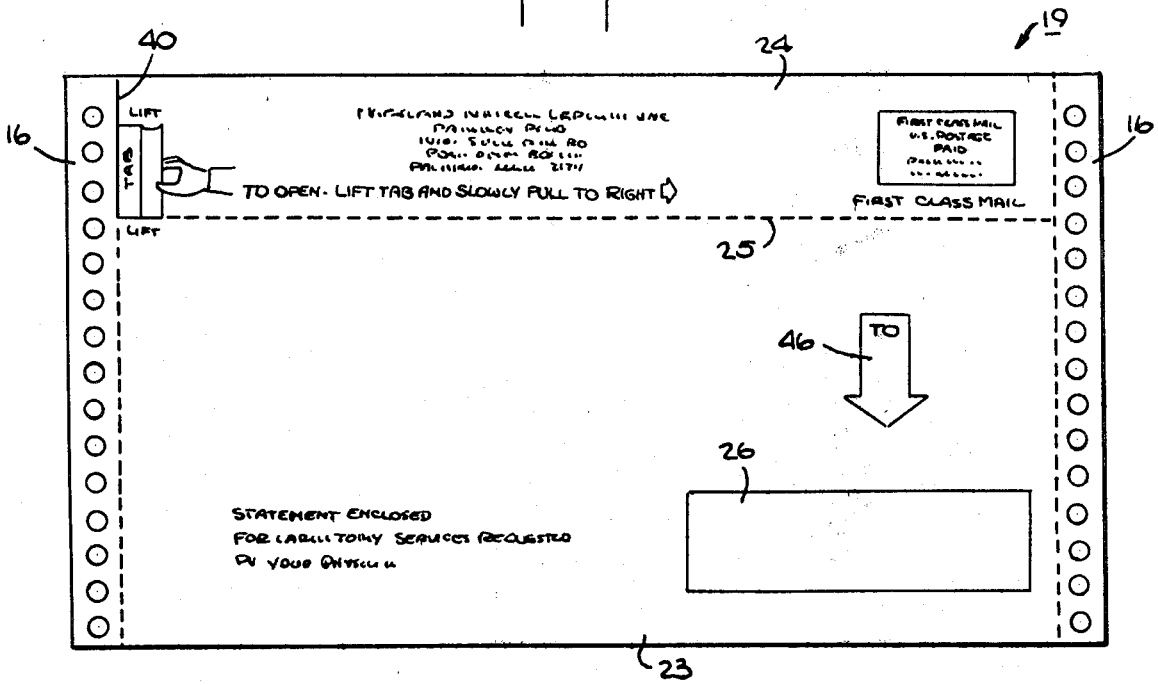
FIG. 11 illustrates a front view of a modified mailer in accordance with the invention.
Figure 12:
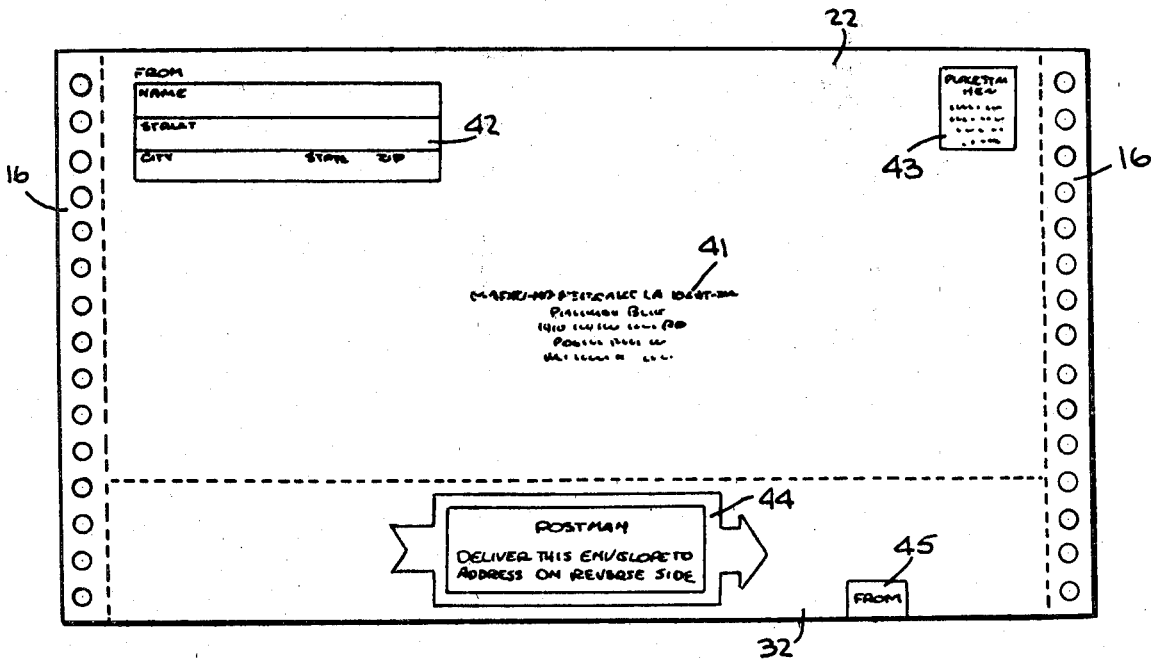
FIG. 12 illustrates a back view of the mailer of FIG. 11.

Referring to FIGS. 11 and 12, wherein like reference characters indicate like parts as above, the mailer 19 may have a designated address area 26 located in a lower region of the body portion 23 of the front ply 21 so that the flap portion 32 is not able to cover the address area 26. The backside of the back ply 22 of the mailer 19 also has a designated address area 41, a return address area 42 and a stamp location 43 as well as a notice location 44 on the flap portion 32 to indicate that the return envelope is to be delivered to the address indicated on the reverse side i.e. the back side of the mailer.

A suitable indicia 45 may also be placed on the backside flap portion 32 to align and overlap with another indicia 46 on the face of the body portion 23. In this case, the indicia 46 on the body portion 23 may be an arrow with the designation "TO" therein while the indicia on the flap portion 32 includes the designation "FROM" which overlies and obscures the designation "TO" when the flap portion 32 if folded over. This will further facilitate use of the mailer and return envelope.

It is to be noted that any number of insert plies may be placed within the continuous mailer, for example, so that a recipient may retain a duplicate copy of material which is returned in the return envelope.

The invention thus provides a mailer which consists of three plies, i.e. the front and back plies 21, 22 and insert message ply 37. These three plies combine to form three documents namely, an outgoing envelope with an easy to open tab feature, a message ply and a return envelope.

The mailer provides for easy opening so as to be readily useable by an addressee. Further, the mailer provides a top open return envelope which can be readily manipulated by an addressee for return mail purposes and which itself can be readily handled in automatic envelope opening equipment.

As the return envelope is of similar size as the mailer, i.e. being of the same width albeit a different depth, the return envelope can be made in sizes, to conform with postal specifications. Further, the return envelope is easy to use particularly with respect to accepting an insert without folding.

The mailer is made of a minimal amount of material so that waste is avoided and so that the fabrication of a mailer assembly can be carried out in a more economical manner.

It is also noted that the mailer assembly can be constructed to define one series of individual mailers or two series of mailers in a side-by-side relation.

What is claimed is:

1. A mailer consisting of a front ply for receiving information thereon, said front ply including a body portion having a designated address area thereon and a removable tab portion adjacent said body portion;

a back ply peripherally secured to said front ply with a U-pattern of adhesive inserted after "front ply"; to define a first enclosed pocket therewith, said back ply having a main portion secured to said body portion of said front ply to define a return mail pocket therewith, and a flap portion underlying said tab portion for folding over onto said body portion after removal of said tab portion;

at least one insert message ply within said first pocket and within, and free of attachment to, said U-pattern of adhesive and extending outwardly of said first pocket to between said tab portion and said first portion;

releasable glue spots releasably securing said tab portion to said flap portion; and adhesive means on said flap portion for sealing against said body portion.

2. A mailer as set forth in claim 1 wherein said flap portion is of a width to cover said designated address area on said body portion.

3. A mailer as set forth in claim 2 wherein said body portion has a return address area on a frontside thereof spaced from said designated address area and said flap portion has a second designated address area on a backside thereof.

4. A mailer as set forth in claim 1 wherein said front ply has a line of perforations separating said tab portion from said body portion.

5. A mailer as set forth in claim 1 wherein said adhesive means includes spaced apart blocks of remoistenable glue.

6. A mailer as set forth in claim 1 wherein said U-pattern of adhesive is comprised of lines of adhesive.

7. A mailer comprising a front ply including a body portion having a designated address area on a frontside thereof, a removable tab portion adjacent said body portion, with a return address area thereon and a line of perforations separating said tab portion from said body portion;

a back ply peripherally secured to said front ply with a U-pattern of adhesive to define a first enclosed pocket therewith, said back ply having a main portion secured to said body portion to define a return main pocket therewith and a flap portion underlying said tab portion for folding over onto said body portion after removal of said tab portion;

at least one insert message ply within said first pocket and within, and free of attachment to, said U-pattern of adhesive and extending outwardly of said first pocket to between said tab portion and said flap portion;

releasable glue means for releaseably securing said tab portion to said flap portion; and remoistenable glue on said flap portion for sealing against said body portion.

8. A mailer as set forth in claim 7 wherein said tab portion has a slit extending to said line of perforations in said front ply to provide a free edge for lifting and peeling of said tab portion from said flap portion.

9. A mailer as set forth in claim 7 wherein said flap portion is of a width to cover said designated address area of said body portion and has a second designated address area on a backside thereof.

10. A mailer as set forth in claim 7 wherein said back ply has a second designated address area and a return address area on a backside thereof.

11. A continuous mailer assembly comprising a plurality of continuous webs disposed in overlying relation, each of said webs having a removable strip with control line holes therein along each of two opposite marginal edges and a plurality of transverse lines of weakening to divide said webs into a series of interconnected multiple ply sections;

each said section including a removable first ply, a second ply including a body portion and a tab portion removably secured to said body portion, a third ply including a main portion peripherally secured to said body portion of said second ply to define a pocket therewith and a flap portion removably secured to said tab portion for folding over onto said body portion after removal of said tab portion and first ply; lines of adhesive securing said back ply to said front ply; and at least one additional ply between said second and third plies to define at least one insert message ply within said pockets and said lines of adhesive between each said body portion and said main portion, said insert being free of attachment to said lines of adhesive wherein said second and third plies of each section form a mailer and said body portion of said second ply and said third ply of each section form a return mail envelope.

12. A continuous mailer assembly as set forth in claim 11 wherein said tab portion has a slit therein to provide a free edge for lifting and peeling of said tab portion from said flap portion.

13. A continuous mailer assembly as set forth in claim 11 wherein said lines of adhesive secure said body portion to said main portion and define a U-pattern with said additional ply within said lines.

14. A continuous mailer assembly as set forth in claim 11 which further comprises adhesive means releasably securing each said tab portion to an underlying flap portion of said third ply.

15. A continuous mailer assembly as set forth in claim 11 wherein each body portion has a designated address area thereon and each flap portion is of a width for folding over said area and has a second designated address area on a backside thereof.

16. A continuous mailer assembly as set forth in claim 11 wherein said main portion of said third ply has a second designated address area and a return address area on a backside thereof.

17. A continuous mailer assembly as set forth in claim 16 wherein said flap portion has a first indicia on a backside to align and overlap a second indicia on said body portion.

* * * * *

UNITED STATES PATENT AND TRADEMARK OFFICE

CERTIFICATE OF CORRECTION

PATENT NO. : 4,418,865

DATED : December 6, 1983

INVENTOR(S) : Charles G. Bowen

It is certified that error appears in the above-identified patent and that said Letters Patent is hereby corrected as shown below:

Column 6, line 41 cancel "inserted after" "front ply";"
Column 8, line 15 change "pockets" to -pocket- Signed and Sealed this

*Twenty-sixth* Day of *March 1985*

[SEAL]

*Attest:*

DONALD J. QUIGG

*Attesting Officer* *Acting Commissioner of Patents and Trademarks*